US006741163B1

(12) United States Patent
Roberts

(10) Patent No.: US 6,741,163 B1
(45) Date of Patent: May 25, 2004

(54) DECORATIVE MOTION DETECTOR

(76) Inventor: Corinna A. Roberts, 339 Hickory Hollow Dr., Jacksonville, FL (US) 32225

( * ) Notice: Subject to any disclaimer, the term of this patent is extended or adjusted under 35 U.S.C. 154(b) by 0 days.

(21) Appl. No.: 08/689,654

(22) Filed: Aug. 13, 1996

(51) Int. Cl.[7] ..... G08B 3/00

(52) U.S. Cl. ..... 340/330; 340/691.1; 340/693.5; 340/541

(58) Field of Search ..... 340/330, 331, 340/332, 565, 567, 286.01, 326, 573.1, 573.4, 691.1, 693.5, 693.9, 541

(56) References Cited

U.S. PATENT DOCUMENTS 3,872,294 A * 3/1975 O'Toole ..... 362/85
4,716,402 A * 12/1987 Francis ..... 340/693
5,015,994 A * 5/1991 Hoberman et al. ..... 340/567
5,165,042 A * 11/1992 Klinger ..... 174/67
5,371,489 A * 12/1994 Carroll et al. ..... 340/565
5,457,286 A * 10/1995 Flasz ..... 174/66
5,521,578 A * 5/1996 DelValle ..... 340/330
5,586,048 A * 12/1996 Coveley ..... 364/492
5,590,953 A * 1/1997 Haslam et al. ..... 362/276
5,749,365 A * 5/1998 Magill ..... 600/484
6,388,404 B1 * 5/2002 Schnebly et al. ..... 318/16

FOREIGN PATENT DOCUMENTS

EP 0334531 * 9/1989

* cited by examiner

*Primary Examiner*—Benjamin C. Lee

(57) ABSTRACT

A decorative motion detector, and a method for its use, that is preferably mounted in the interior of an occupied dwelling near an interior doorway area wall to a child's room in an operative position to warn a parent or guardian when people leave or enter the child's room through that doorway. The detector is mounted to an essentially planar base member having a rear wall, a decorative front wall, and a cavity therebetween so that its presence in a conspicuous position near the interior door is aesthetically pleasing and so that the decorative design on its true function of the present invention is disguised. When armed, the present invention generates a signal upon detection of movement within the doorway and the signal is transmitted to an alarm device that may generate an audible alarm, a visual alarm, or both. A low power light can be mounted on the base member so that it functions as a nightlight, as well as serve as a visual alarm when it is connected to the motion detector in a way that allows it to operate intermittently so as to flicker or blink when a person moves through the monitored doorway.

17 Claims, 3 Drawing Sheets

DECORATIVE MOTION DETECTOR

BACKGROUND OF THE INVENTION

1. Field of the Invention

This invention relates, generally, to motion detectors. More particularly, it relates to an alarm device, and a method for its use that notifies a parent when a child or other individual has left or entered a preselected room of a dwelling through an interior doorway to the room.

2. Description of the Prior Art

Motion detectors are well known and widely used. Typically, they are positioned near exterior doorways or windows of a building for monitoring the area around the building. Upon detecting motion, they generate an electrical signal that is transmitted to a preselected audible alarm or lighting device which is then activated.

Such exterior motion detectors do not detect motion within a building. If a parent orders a child to remain within his or her room for a set period of time, a conventional motion detector positioned by an exterior window to the child's room will not generate a signal if the child leaves the room through an interior doorway to the room, or if someone else enters it through an interior doorway.

What would be useful to have, and is not known, is a motion detecting device for alerting a parent that a child has left his or her room through an interior doorway to the room, or that an unauthorized person has entered the room through an interior doorway.

Another disadvantage of known motion detectors for interior use is that they are utilitarian in appearance and non-decorative. However, to be effective motion detectors must be placed in unobstructed, conspicuous positions where they are readily noticed and identified. Thus, there is a need for a decorative motion detector that can blend in with the decor of a child's room so that its presence is not unsightly. Of even more importance is a need to have a disguised motion detector with a decorative design which incorporates therein the shape of the motion detector so as to conceal it so that its function will be unknown to someone who casually inspects it. To the casual observer, the present invention would simply look like a wall plaque decorated with designs that would be appropriate to the decor expected in a child's room.

It is not known to have a motion detecting device with decorative designs sufficient in complexity and number to conceal to a causal observer the presence of its motion detector and which when placed in operative proximity to the entrance of a child's room will alert the parent or guardian that a child told to remain in that room may no longer be there.

SUMMARY OF THE INVENTION

The longstanding but heretofore unfulfilled need for a device that can monitor movement of people passing through the entrance of a child's room and whose function can be concealed from the casual observer is now met by the present invention. The present invention includes an essentially planar base member having a front wall and a rear wall, a motion detector mounted through the front wall, and an alarm means also mounted through the front wall. The motion detector is adapted to generate a signal upon detection of movement within a targeted area. The motion detector is in electrical communication with the alarm means so that a signal generated by the motion detector is transmitted to and activates the alarm means.

The flat base member is positioned in operable proximity to an interior doorway of a preselected room within which a child is located so that the alarm means is activated when movement of the child or another person through a monitored entrance to the room is identified by the motion detector.

In a preferred embodiment, the base member has a predetermined thickness and includes an aperture within which is positioned the motion detector and the alarm means.

A power supply is mounted on the rear wall of the base member; the power supply is in electrical communication with the motion detector and the alarm means through the space or cavity between the rear wall and the front wall.

The present invention can also include a nightlight mounted on the front wall of the device, with the nightlight also in electrical communication with the power supply.

A decorative indicia is made part of the front wall for aesthetic purposes and also for the purpose of disguising the true function of the device to the casual observer.

The base member may also be luminescent so that it glows at night to provide a nightlight function.

Where the nightlight provided is incandescent or fluorescent it may be in electrical communication with the motion detector so that a movement activated signal generated by the motion detector operates to cause intermittent function or flashing of the nightlight to provide a visual alarm.

It is a primary object of this invention to provide a means whereby a parent or guardian is notifed when a child leaves a preselected room through an interior entrance to the room, or when anyone else enters the room.

Another object is to provide such means in the form of a decorative device so that it may be mounted in a highly visible location with an aesthetic effect and without revealing its true function to a casual observer.

These and other important objects, features, and advantages of the invention will become apparent as this description proceeds.

The scope of the present invention accordingly comprises features of construction, combinations of elements and arrangements of parts beyond that disclosed in the preferred embodiments identified herein, and the scope of the invention should therefore be determined by reference to the claims.

DETAILED DESCRIPTION OF THE PREFERRED EMBODIMENT

Figure 1:
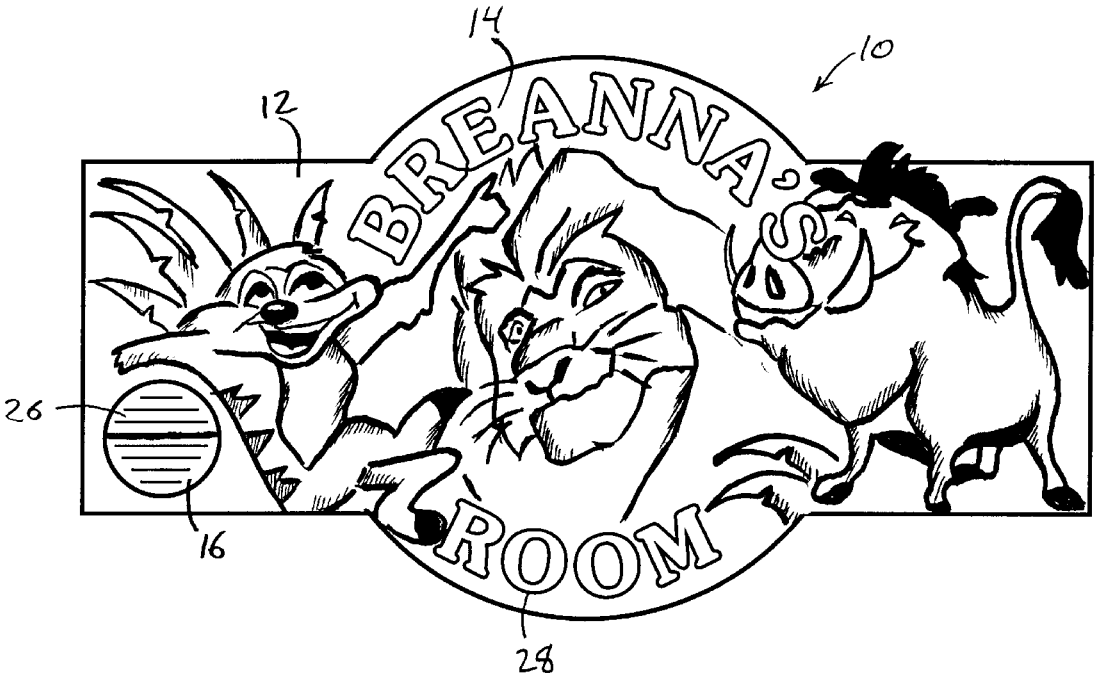
FIG. 1 is a front elevational view of an preferred embodiment of the invention.

FIG. 1 shows embodiment of the present invention as a whole by the reference numeral 10.

Device 10 is preferably provided in the form of an essentially planar base member 12 having a predetermined nominal thickness; it could be made of relatively rigid plastic or other suitable material. In this illustrated embodiment, the front wall of base member 12 is covered with a decorative indicia 14 including pictures of animals and the notation "Breanna's Room," indicating an example of the name of a child whose room entrance (not shown) is guarded by device 10.

Figure 2:
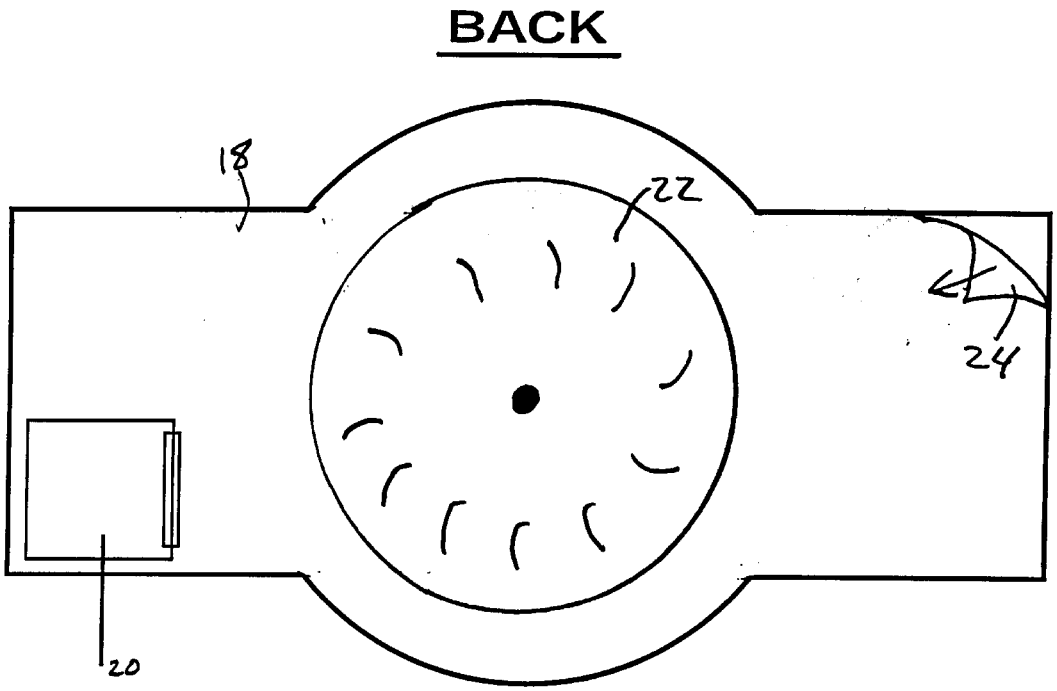
FIG. 2 is a rear elevational view preferred emblodiment.

A motion detector 16 is mounted on base member 12; in this preferred embodiment, base member 12 is apertured to receive motion detector 16 therethrough, thereby facilitating connection of motion detector 16 to a power supply, shown in FIG. 2 as number 20.

FIG. 2 depicts the reverse or rear wall 18 of base member 12. A power supply 20 is mounted thereto and although not shown it is contemplated for power supply 20 to be, in electrical communication with motion detector 16.

A centrally mounted suction cup 22 may be employed to mount base member 12 to a wall adjacent an interior door to the child's room. Alternatively, a fastening means such as the well-known "peel and seal" type of fastening means 24 could be employed.

Figure 3:
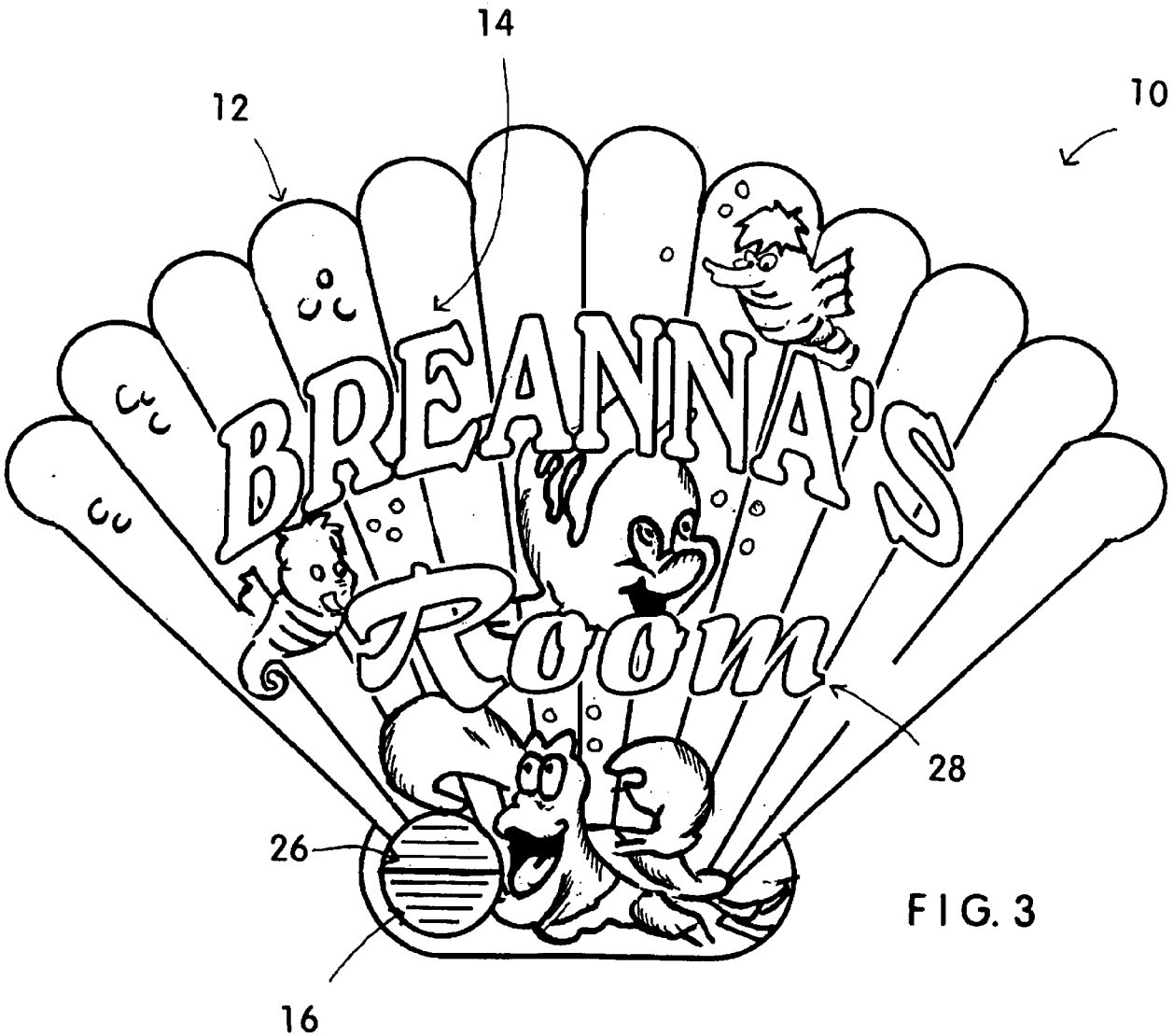
FIG. 3 is a front elevational view of a second preferred embodiment.

FIG. 3 depicts a scallop shell-shaped base member 12 however, it is contemplated for member 12 to take any aesthetically-pleasing, function-disguising form.

It is also comtemplated for alarm means 26, shown in FIG. 1, to be in electrical communication with motion detector 16 and power supply 20 and to be activated by a signal generated by motion detector 16 when motion detector 16 is armed. As indicated in FIG. 1, alarm means 26 may share the same aperture formed in base member 12 that receives motion detector 16. Although not shown, alarm means 26 may produce an audible alarm to alert a parent or guardian that the child has left his or her room (or that someone else has entered or exited said room). Alternatively, alarm means 26 may produce a visual alarm or a combination visual and audible alarm. Tactile and other types of alarms are also within the scope of this invention. Thus, the parent's pillow could be made to vibrate, for example, in lieu of or in addition to the other types of alarms.

Base member 12 could be made of a luminescent material so that it glows in the dark to provide a nightlight. Alternatively, a separate nightlight 28, as shown in FIG. 1, could be provided by illuminating the text on the base member as indicated by reference numeral 28, or by providing any other light source and mounting it to the front wall of said base member 12.

Another visual alarm could be provided by causing nightlight 28 to blink on and off upon receipt of a signal from motion detector 16.

It will thus be seen that the objects set forth above, and those made apparent from the foregoing description, are set forth as examples of preferred embodiments. Since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A monitoring device for identifying when a person passes through the entrance to a child's room, said device being configured as an artistic wall decoration so as to not reveal its function to a casual observer and comprising a essentially planar base member having a front wall and a rear wall, said base member being positioned within operable proximity of the entrance to a child's room;

motion detection means mounted on said base member and exposed through said front wall in a position whereby a person passing through the room entrance will activate said motion detecting means;

a plurality of decorative designs on said front wall which blend in with and complement decor that would be typically used in a child's room, said decorative designs having sufficient complexity and number to disguise said motion detecting means;

mounting means for attaching said base member to an object within operable proximity to the entrance to a child's room;

alarm means also mounted on said base member and exposed through said front wall;

power supply means attached to said base member and electrically connected to both said motion detecting means and said alarm means;

said motion detection means being adapted to generate a signal upon detection of a person passing through the room entrance; and said motion detection means being in electrical communication with said alarm means so that upon generation of a signal, said signal is immediately transmitted to and activates said alarm means.

2. The device of claim 1 wherein said base member has an aperture of sufficient dimension for housing both said motion detecting means and said alarm means.

3. The device of claim 2 wherein said alarm means is selected from a group consisting of audio alarms, visual alarms, and tactile alarms.

4. The device of claim 3 further comprising a nightlight mounted on said front wall of said base member, said nightlight being in electrical communication with said power supply.

5. The device of claim 4 wherein said nightlight is in electrical communication with said motion detecting means, and wherein said signal generated by said motion detector is operable to cause flashing of said nightlight.

6. The device of claim 3 wherein said visual alarms are selected from a group consisting of incandescent lights adapted for creating a blinking signal, fluorescent lights adapted for creating a blinking signal, and lighted name plates adapted for creating a blinking signal.

7. The device of claim 1 wherein said alarm means comprises a tactile alarm adapted to remotely vibrate a pillow.

8. The device of claim 1, wherein said base member is luminescent.

9. The device of claim 1 wherein said mounting means is selected from a group consisting of suction cups and peel-and-seal adhesive fasteners.

10. A method of using a motion detector for identifying movement of a person through the entrance to a child's room, said method comprising the steps of providing a base member, a motion detector, a plurality of camouflaging decorative designs, an alarm, a power supply, and a mounting device;

attaching said camouflaging decorative designs to the front of said base member;

attaching said motion detector to said base member in a position where said decorative designs conceal it to a casual observer;

attaching said alarm to said base member in a position where said decorative designs conceal it to a casual observer;

attaching said power supply to said base member in a position where it is hidden from a casual observer;

electrically connecting said power supply to said alarm and said motion detector;

electrically connecting said alarm to said motion detector; and using said mounting device to position said base member near to the entrance to a child's room where said motion detector would be in operable proximity to the room entrance to detect people passing through the room entrance and upon detecting movement of a person passing through the room entrance generate a signal that activate said alarm.

11. The method of claim 10 wherein said steps of attaching said alarm to said base member and attaching said motion detector to said base member both involve attachment through a single aperture in said base member.

12. The method of claim 10 wherein said step of providing said alarm comprises the step of providing an alarm selected from a group consisting of audio alarms, visual alarms, and tactile alarms.

13. The method of claim 12 wherein said step of providing said visual alarms comprises the step of providing visual alarms selected from a group consisting of incandescent lights adapted for creating a blinking signal, fluorescent lights adapted for creating a blinking signal, and lighted name plates adapted for creating a blinking signal.

14. The method of claim 10 further comprising the steps of providing a nightlight, attaching said nightlight to said base member, and electrically connecting said nightlight to said power supply.

15. The method of claim 14 further comprising the steps of electrically connecting said nightlight to said motion detector so that said signal generated by said motion detector is operable to cause flashing of said nightlight.

16. The method of claim 10 wherein said step of providing said alarm comprises the step of providing a tactile alarm adapted to remotely vibrate a pillow.

17. The method of claim 10 wherein said step of providing said mounting device comprises the step of providing mounting devices selected from a group consisting of suction cups and peel-and-seal adhesive fasteners.

* * * * *